US011040848B2

(12) United States Patent
Cardona et al.

(10) Patent No.: US 11,040,848 B2
(45) Date of Patent: Jun. 22, 2021

(54) ELEVATOR MACHINE BRAKE DELAY CONTROL

(71) Applicant: OTIS ELEVATOR COMPANY, Farmington, CT (US)

(72) Inventors: Camilo Cardona, West Hartford, CT (US); Prasanna Nagarajan, Farmington, CT (US); Antoine Adrian Blanchard, Chateauneuf sur Loire (FR); Emmanuel Convard, La Bussiere (FR); Gregor Stricker, Berlin (DE); Michael Peters, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 602 days.

(21) Appl. No.: 15/937,104

(22) Filed: Mar. 27, 2018

(65) Prior Publication Data

US 2019/0300330 A1 Oct. 3, 2019

(51) Int. Cl.

| | |
|---|---|
| ***B66B 1/32*** | (2006.01) |
| ***B66B 1/34*** | (2006.01) |
| ***B66B 5/00*** | (2006.01) |
| ***B66B 5/02*** | (2006.01) |
| ***B66B 5/28*** | (2006.01) |

(52) U.S. Cl.

CPC ..... *B66B 1/32* (2013.01); *B66B 1/3492* (2013.01); *B66B 5/0031* (2013.01); *B66B 5/02* (2013.01); *B66B 5/28* (2013.01); *B66B 2201/00* (2013.01)

(58) Field of Classification Search

CPC .... B66B 1/18; B66B 1/32; B66B 5/02; B66B 5/0031; B66B 1/52; B66B 5/04; B66B 5/18; B66B 1/3492; B66B 5/044; B66B 1/36; B66B 5/16; B66B 5/0006; B66B 5/0018; B66B 5/024; B66B 5/0093; B66B 3/02; B66B 5/022; B66B 13/24; B66B 5/0012; B66B 5/0043; B66B 5/28

See application file for complete search history.

(56) References Cited

U.S. PATENT DOCUMENTS

| | | | |
|---|---|---|---|
| 6,526,368 | B1 | 2/2003 | Coste et al. |
| 7,712,584 | B2 | 5/2010 | Aulanko et al. |
| 8,890,448 | B2 | 11/2014 | Putkinen et al. |

(Continued)

FOREIGN PATENT DOCUMENTS

| | | | |
|---|---|---|---|
| EP | 1953107 | A1 | 8/2008 |
| WO | 2006/082275 | A2 | 8/2006 |
| WO | 2009/127772 | A1 | 10/2009 |

OTHER PUBLICATIONS

Extended European Search Report for Application No. EP 19 16 5616 dated Sep. 24, 2019.

*Primary Examiner* — Marlon T Fletcher
(74) *Attorney, Agent, or Firm* — Carlson, Gaskey & Olds

(57) ABSTRACT

An illustrative elevator system includes an elevator car, a machine including a motor that provides a motive force for moving the elevator car along a travel path and a brake that resists movement of the elevator car, and a brake controller. The brake controller is configured to determine when the elevator car is within a selected range of at least one end of the travel path. The brake controller inhibits a delay in application of the brake when the elevator car is within the selected range and permits a delay in application of the brake when the elevator car is outside of the selected range.

20 Claims, 2 Drawing Sheets

(56) References Cited

U.S. PATENT DOCUMENTS

| | | | | |
|---|---|---|---|---|
| 9,434,575 | B2 | 9/2016 | Kattainen et al. | |
| 9,457,987 | B2 | 10/2016 | Della Porta | |
| 9,469,504 | B2 | 10/2016 | Hopp | |
| 9,546,074 | B2 | 1/2017 | Okamoto et al. | |
| 9,604,819 | B2 | 3/2017 | Kattainen et al. | |
| 2010/0170751 | A1* | 7/2010 | Hashimoto | B66B 1/32 187/288 |
| 2015/0353321 | A1* | 12/2015 | Fargo | B66B 5/02 187/276 |
| 2016/0167921 | A1 | 6/2016 | Kattainen et al. | |
| 2019/0300330 | A1* | 10/2019 | Cardona | B66B 1/3492 |

* cited by examiner

ELEVATOR MACHINE BRAKE DELAY CONTROL

BACKGROUND

Elevator systems have proven useful for carrying individuals and cargo among various levels in a building. Typical elevator systems have a machine including a motor and a brake for controlling movement and position of the elevator car. Under normal operating conditions, the machine motor is controlled to slow down the elevator car and the machine brake holds the car at a landing.

Elevator systems typically include additional braking devices, which are often referred to as safeties, to stop elevator car movement during an overspeed condition. In some elevator systems, the machine brake is used for applying a braking force to stop the elevator car during predetermined conditions, such as when the power supply is interrupted. One of the drawbacks associated with stopping an elevator car under such conditions is that the stop tends to be very abrupt and can cause passengers discomfort or to be very uneasy. There are challenges associated with attempting to control machine brake application under such conditions to avoid an overly abrupt stop while also accounting for various other features of the elevator system that may be adversely affected, depending on how the machine brake is deployed.

SUMMARY

An illustrative elevator system includes an elevator car, a machine including a motor that provides a motive force for moving the elevator car along a travel path and a brake that resists movement of the elevator car, and a brake controller. The brake controller is configured to determine when the elevator car is within a selected range of at least one end of the travel path. The brake controller inhibits a delay in application of the brake when the elevator car is within the selected range and permits a delay in application of the brake when the elevator car is outside of the selected range.

An example embodiment having one or more features of the elevator system of the previous paragraph includes a detector that detects a position of the elevator car. The brake controller receives a position signal from the detector indicating that the elevator car is within the selected range.

In an example embodiment having one or more features of the elevator system of any of the previous paragraphs, the brake controller is configured to provide a delay command that causes the delay in application of the brake when the elevator car is outside the selected range, and the brake controller is configured to disable the delay command based on the position signal.

In an example embodiment having one or more features of the elevator system of any of the previous paragraphs, the selected range is configured to accommodate a latency between the elevator car entering the selected range and the brake controller receiving the position signal.

In an example embodiment having one or more features of the elevator system of any of the previous paragraphs, the selected range is configured based on a braking torque of the brake and a load of the elevator car.

In an example embodiment having one or more features of the elevator system of any of the previous paragraphs, the brake controller is configured to inhibit or permit the delay in application of the brake during an emergency braking scenario.

In an example embodiment having one or more features of the elevator system of any of the previous paragraphs, the detector comprises a limit switch situated near a position of the elevator car near an edge of the selected range.

In an example embodiment having one or more features of the elevator system of any of the previous paragraphs, the brake controller disables the delay in application of the brake when the elevator car is within the selected range.

An example embodiment having one or more features of the elevator system of any of the previous paragraphs includes a buffer near the at least one end of the travel path and the selected range is based on at least one characteristic of the buffer.

An illustrated example method of controlling a machine brake in an elevator system that includes an elevator car that moves along a travel path comprises determining when the elevator car is within a selected range of at least one end of the travel path, inhibiting a delay in application of the brake when the elevator car is within the selected range, and permitting a delay in application of the brake when the elevator car is outside of the selected range.

An example embodiment having one or more features of the method of the previous paragraph includes using a detector for detecting when the elevator car is within the selected range and providing a position signal from the detector indicating that the elevator car is within the selected range.

An example embodiment having one or more features of the method of any of the previous paragraphs includes using a brake controller to provide a delay command that causes the delay in application of the brake when the elevator car is outside the selected range. The brake controller is configured to disable the delay command based on the position signal.

In an example embodiment having one or more features of the method of any of the previous paragraphs, the selected range is configured to accommodate a latency between the elevator car entering the selected range and the brake controller receiving the position signal.

In an example embodiment having one or more features of the method of any of the previous paragraphs, the selected range is configured based on a braking torque of the brake and a load of the elevator car.

An example embodiment having one or more features of the method of any of the previous paragraphs includes inhibiting or permitting the delay in application of the brake during an emergency braking scenario.

In an example embodiment having one or more features of the method of any of the previous paragraphs, the detector comprises a limit switch situated near a position of the elevator car near an edge of the selected range.

An example embodiment having one or more features of the method of any of the previous paragraphs includes disabling the delay in application of the brake when the elevator car is within the selected range.

An example embodiment having one or more features of the method of any of the previous paragraphs includes a buffer at the end of the travel path and the selected range is based on at least one characteristic of the buffer.

The various features and advantages of at least one disclosed example embodiment will become apparent to those skilled in the art from the following detailed description. The drawings that accompany the detailed description can be briefly described as follows.

DETAILED DESCRIPTION

Embodiments of this invention allow for controlling elevator machine brake application during overspeed conditions or emergency braking scenarios. A delay in application of the machine brake provides a smoother stop and the control technique allows for such a delay to be used under a variety of scenarios while addressing the requirements of other components within the hoistway or elevator system.

Figure 1:
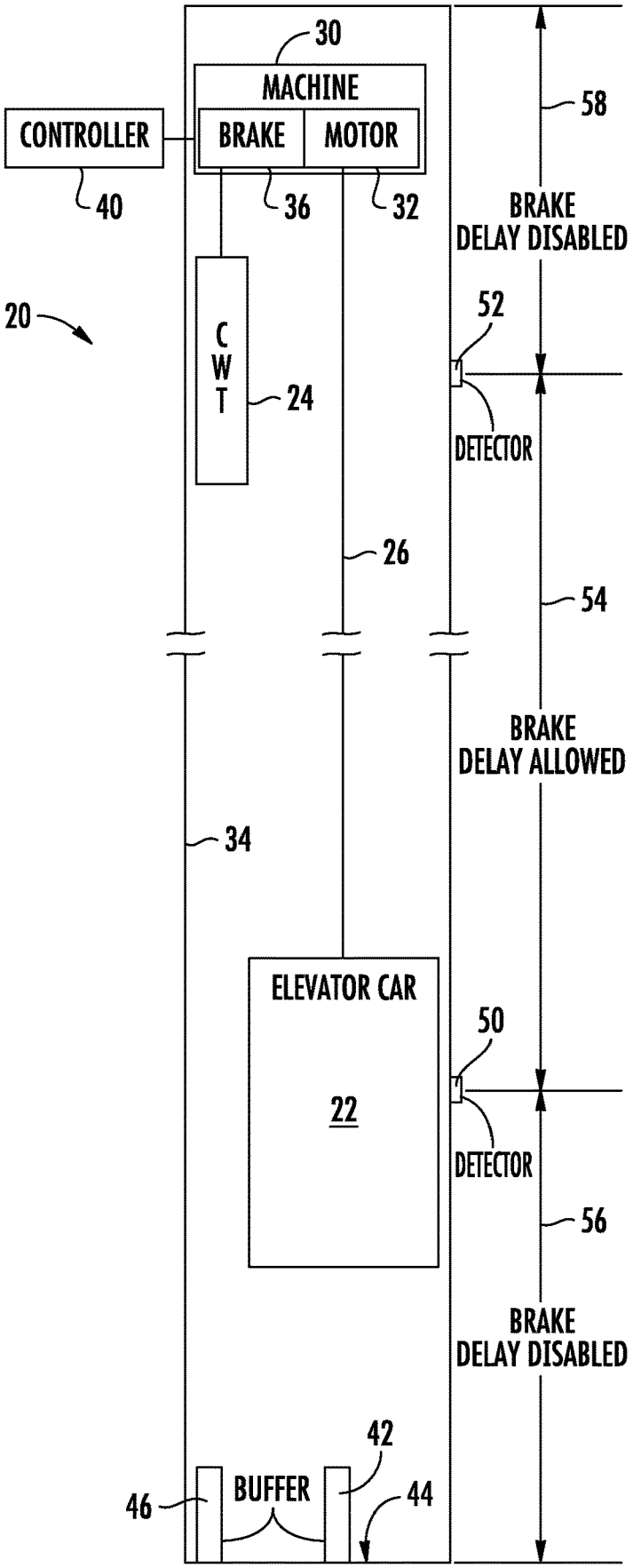
FIG. 1 schematically illustrates selected portions of an elevator system designed according to an embodiment of this invention.

FIG. 1 schematically illustrates selected portions of an elevator system 20, which is one example embodiment of this invention. An elevator car 22 and counterweight 24 are connected by a roping assembly 26. A machine 30 includes a motor 32 that causes rotation of a traction sheave (not illustrated) to cause movement of the roping assembly 26 for moving the elevator car 22 along a travel path within a hoistway 34. The machine 30 includes a brake 36 that applies a braking force for decelerating the elevator car 22 and holding it in place at a landing when necessary. The machine brake 36 is also useful during an overspeed condition or an emergency stop situation to prevent movement of the elevator car 22.

A brake controller 40 controls operation of the machine brake 36 during an overspeed or emergency stop situation. The brake controller 40 is configured to control whether the application of a braking force by the machine brake 36 is delayed. When the machine brake 36 is used during an emergency stop situation, the application of the braking force may cause the elevator car 22 to abruptly come to a stop. The brake controller 40 facilitates including a delay in the application of the braking force to smooth out the way in which the elevator car stops. Such a delay, however, is not desirable under all conditions or for all positions of the elevator car 22 within the hoistway 34.

The brake controller 40 in some embodiments is part of an elevator controller while in others the brake controller 40 is part of the elevator drive. Some embodiments include a separate or dedicated computing device or processor as the brake controller 40.

The example system 20 includes at least one buffer 42 situated near a bottom 44 of the hoistway 34, which corresponds to one end of the travel path of the elevator car 22. The buffer 42 operates in a known manner to provide a cushion between the elevator car 22 and the bottom 44 of hoistway 34 in the event that the elevator car 22 were to descend low enough for there to be contact between the elevator car 22 and the buffer 42.

The example system 20 includes another buffer 46 situated beneath the counterweight 24. In this example, the buffers 42 and 46 are reduced stroke buffers in that they are relatively smaller and their moving components move along a reduced stroke distance during buffer activation.

One issue associated with including a delay in the application of the machine brake 36 is that such a delay may have an adverse affect, for example, when the elevator car 22 is within close range of the buffer 42. The brake controller 40 is configured to selectively permit or inhibit the delay of application of the machine brake 36 based upon a position of the elevator car 22 relative to at least one end of the travel path of the elevator car 22.

The brake controller 40 receives information regarding a position of the elevator car from a detector, which may be realized through a software module or physical devices within the hoistway 34. The illustrated example system 20 includes detectors 50 and 52 situated along the hoistway 34 for detecting a position of the elevator car 22. In particular, the detectors 50 and 52 provide an indication of a position of the elevator car 22 within a selected range of an end of the travel path of the elevator car 22. When the elevator car 22 is within a selected range of an end of its travel path, the brake controller 40 inhibits the delay in application of the machine brake 36 so that the elevator car 22 can be brought to a stop quickly enough to compensate for at least one characteristic of the buffer 42 (or 46), such as the reduced stroke distance of the buffer.

The detectors 50 and 52 are situated along the hoistway 34 in the illustration in a way that demonstrates how the hoistway 34 or travel path of the elevator car 22 can be effectively divided into sections. In the section shown at 54, which includes the center portion of the hoistway 34, there is no concern with allowing for or providing a delay in the application of the machine brake 36 during an overspeed or emergency stop situation. In the section 56 beneath the detector 50, the delay should be inhibited or prevented to avoid the elevator car 22 contacting the buffer 42 at a higher than desired speed. If the elevator car 22 is within the section 58, which establishes a selected range near the upper end of the travel path of the elevator car 22, inhibiting brake application delay ensures that the counterweight 24 will not strike the buffer 46 at a higher than desired speed. Additionally, inhibiting delay in the application of the machine brake 36 when the elevator car 22 is within the section 58 (i.e., within a selected range of the upper end of the travel path) protects against contact between the elevator car 22 and components situated near the top of the hoistway 34, such as the machine 30 and the structure used for mounting or supporting the machine 30.

Figure 2:
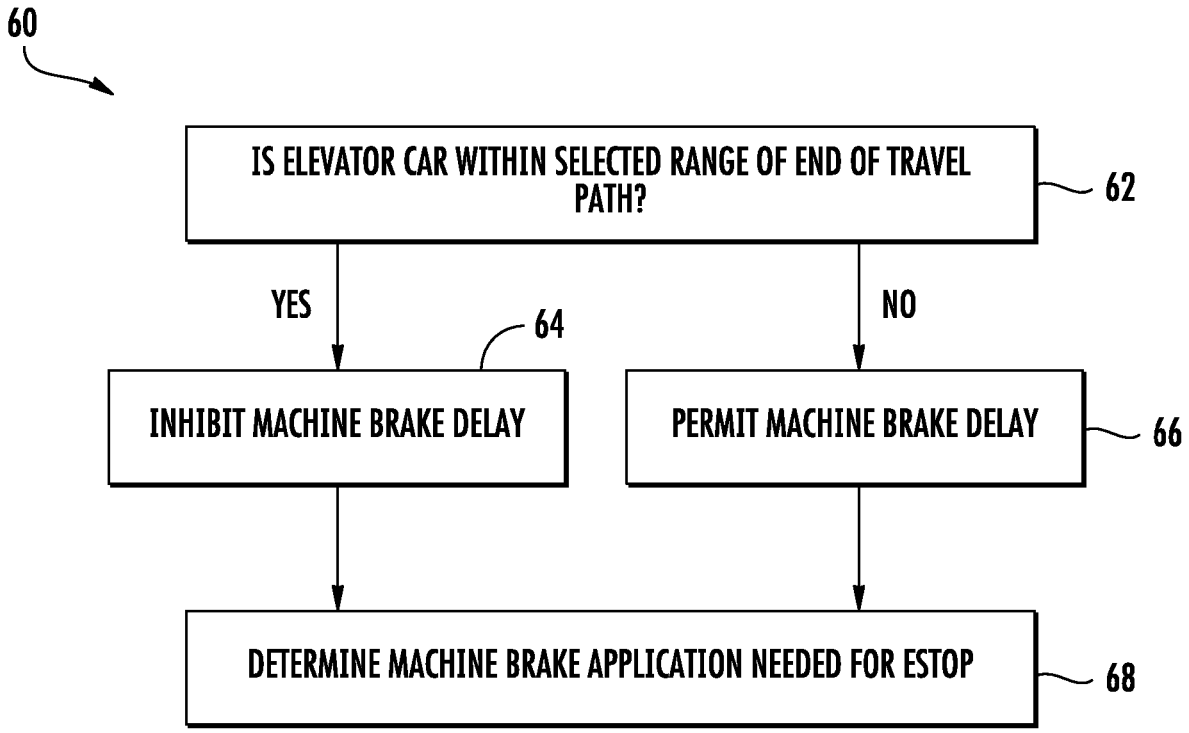
FIG. 2 is a flowchart diagram summarizing an example machine brake control strategy designed according to an embodiment of this invention.

FIG. 2 includes a flowchart diagram 60 that summarizes an example approach used by the brake controller 40 for controlling the machine brake 36. At 62, the brake controller 40 determines whether the elevator car 22 is within the selected range of an end of the travel path. When the elevator car 22 is within that range, the brake controller 40 inhibits the machine brake application delay at 64. Inhibiting or preventing the delay in the brake application ensures that the machine brake 36 will apply a braking force quickly enough to bring the elevator car 22 to a stop when it is within the selected range of an end of the travel path to avoid undesired contact between the elevator car 22 and the buffer 42 or another component within the hoistway.

If the elevator car 22 is outside of the selected range, the brake controller 40 permits or provides the brake delay at 66. Depending on whether the brake delay is prohibited or not, at 68 the brake controller 40 determines when the machine brake 36 is needed for an emergency stop and applies the brake 36 with or without the delay depending on the position of the elevator car 22 relative to the end of the travel path.

In some embodiments, the detectors 50 and 52 provide a positon signal to the brake controller 40 indicating when the elevator car 22 is within the selected range of an end of the travel path. In the illustrated example, the size of the selected range is set to accommodate or account for a latency in signal communication between the detectors 50 and 52 and the brake controller 40. For example, there may be a latency associated with the position signal from the detector 50 being received by the brake controller 40 and interpreted in a manner that the brake controller 40 responsively prohibits delaying the brake application. The size of the selected range is set to account for any such latency. Another latency may be associated with the processing within the brake controller 40 required to inhibit the delay of the brake application.

Other factors that are utilized for selecting the size of the range within which brake delay will be prohibited include the brake torque of the machine brake 36, the load of the elevator car 22, and the size of the buffer 42.

In the illustrated example, the brake controller 40 operates normally to permit or provide the delay in application of the machine brake 36. When it is necessary to inhibit or prevent the brake delay, the brake controller 40 activates a switch, which may be realized through software. In another embodiment, a physical switch, such as a limit switch, serves as the component for changing from a condition in which brake delay is allowed to one in which brake delay is prohibited.

In some embodiments the brake controller 40 provides a delay command when delaying machine brake application is acceptable. The brake controller 40 disables the delay command when the elevator car 22 is within the selected range.

One feature of the disclosed example embodiment is that it allows for an emergency stop to be accomplished in a way that is more comfortable for passengers in the elevator car 22 without compromising control over the brake application that is required when the elevator car 22 is in specific places within the hoistway 34, such as near an end of the travel path. The use of a reduced stroke buffer requires the use of the brake to decelerate the elevator prior to impacting the buffer. The manner in which the brake controller 40 prohibits delay in the brake application guarantees a safe buffer striking speed because whenever the elevator car 22 enters a portion of the hoistway 34 that is within a selected range of an end of the travel path, the delay in brake application will be prohibited and no further active control is required to control the timing of the brake application during an emergency stop scenario once the stop has been triggered.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

an elevator car;

a machine including a motor that provides a motive force for moving the elevator car along a travel path and a brake that resists movement of the elevator car; and a brake controller configured to determine when the elevator car is within a selected range of at least one end of the travel path, inhibit a delay in application of the brake when the elevator car is within the selected range, and permit a delay in application of the brake when the elevator car is outside of the selected range.

2. The elevator system of claim 1, comprising a detector that detects a position of the elevator car and wherein the brake controller receives a position signal from the detector indicating that the elevator car is within the selected range.

3. The elevator system of claim 2, wherein the brake controller is configured to provide a delay command that causes the delay in application of the brake when the elevator car is outside the selected range; and the brake controller is configured to disable the delay command based on the position signal.

4. The elevator system of claim 3, wherein the selected range is configured to accommodate a latency between the elevator car entering the selected range and the brake controller receiving the position signal.

5. The elevator system of claim 4, wherein the selected range is configured based on at least a braking torque of the brake and a load of the elevator car.

6. The elevator system of claim 2, wherein the detector comprises a limit switch situated near a position of the elevator car near an edge of the selected range.

7. The elevator system of claim 1, wherein the brake controller disables the delay in application of the brake when the elevator car is within the selected range.

8. The elevator system of claim 1, wherein the brake controller is configured to inhibit or permit the delay in application of the brake during an emergency braking scenario.

9. The elevator system of claim 1, comprising a buffer at the at least one end of the travel path and wherein the selected range is based on at least one characteristic of the buffer.

10. The elevator system of claim 1, wherein the travel path is in a hoistway, the hoistway has one end at a top of the hoistway and another end at a bottom of the hoistway, and the selected range from the at least one end of the travel path comprises a distance from the top of the hoistway or a distance from the bottom of the hoistway.

11. A method of controlling a machine brake in an elevator system that includes an elevator car that moves along a travel path, the method comprising:

determining when the elevator car is within a selected range of at least one end of the travel path;

inhibiting a delay in application of the brake when the elevator car is within the selected range; and permitting a delay in application of the brake when the elevator car is outside of the selected range.

12. The method of claim 11, comprising using a detector for detecting when the elevator car is within the selected range; and providing a position signal from the detector indicating that the elevator car is within the selected range.

13. The method of claim 12, comprising using a brake controller to provide a delay command that causes the delay in application of the brake when the elevator car is outside the selected range and wherein the brake controller is configured to disable the delay command based on the position signal.

14. The method of claim 13, wherein the selected range is configured to accommodate a latency between the elevator car entering the selected range and the brake controller receiving the position signal.

15. The method of claim 14, wherein the selected range is configured based on a braking torque of the brake and a load of the elevator car.

16. The method of claim 12, wherein the detector comprises a limit switch situated near a position of the elevator car near an edge of the selected range.

17. The method of claim 11, comprising disabling the delay in application of the brake when the elevator car is within the selected range.

18. The method of claim 1, comprising inhibiting or permitting the delay in application of the brake during an emergency braking scenario.

19. The method of claim 11, comprising a buffer at the at least one end of the travel path and wherein the selected range is based on at least one characteristic of the buffer.

20. The method of claim 11, wherein the travel path is in a hoistway, the hoistway has one end at a top of the hoistway and another end at a bottom of the hoistway, and the selected range from the at least one end of the travel path comprises a distance from the top of the hoistway or a distance from the bottom of the hoistway.

* * * * *